US007402231B2

(12) United States Patent
Oikawa et al.

(10) Patent No.: US 7,402,231 B2
(45) Date of Patent: Jul. 22, 2008

(54) METHOD AND APPARATUS FOR PARTIALLY PLATING WORK SURFACES

(75) Inventors: Wataru Oikawa, Tochigi (JP); Akira Takumi, Tochigi (JP); Tomonori Zenbayashi, Tochigi (JP)

(73) Assignee: Nippon Platec Co., Ltd., Tochigi (JP)

( * ) Notice: Subject to any disclaimer, the term of this patent is extended or adjusted under 35 U.S.C. 154(b) by 518 days.

(21) Appl. No.: 10/935,590

(22) Filed: Sep. 8, 2004

(65) Prior Publication Data

US 2005/0056541 A1 Mar. 17, 2005

(30) Foreign Application Priority Data

Sep. 17, 2003 (JP) ..... 2003-324977

(51) Int. Cl.
*C25D 5/02* (2006.01)

(52) U.S. Cl. ..... 205/118; 205/151

(58) Field of Classification Search ..... 205/118, 205/135, 136, 96, 151
See application file for complete search history.

(56) References Cited

U.S. PATENT DOCUMENTS 2,362,228 A * 11/1944 Wright ..... 205/118
4,904,365 A * 2/1990 Kawamura et al. ..... 204/623
5,368,719 A * 11/1994 Troup-Packman ..... 205/213
5,665,217 A * 9/1997 Gruver et al. ..... 205/110

FOREIGN PATENT DOCUMENTS

| | | |
|---|---|---|
| CN | 87-107696 | 7/1988 |
| JP | U58-148065 | 10/1983 |
| JP | U63-24267 | 2/1988 |
| JP | U1-149464 | 10/1989 |
| JP | P9-170100 | 6/1997 |
| JP | P-11-269697 | 10/1999 |
| JP | P-2001-335993 | 12/2001 |

* cited by examiner

*Primary Examiner*—Nam X Nguyen
*Assistant Examiner*—Luan V Van
(74) *Attorney, Agent, or Firm*—Maier & Maier, PLLC

(57) ABSTRACT

For partially plating work surfaces, a tubular shield member is set around a work which is connected to a cathode, in face to face and in predetermined small gap relation with a non-plating surface or surfaces of a work. In a plating bath, an anode is located on the outer side of the shield member to cover the non-plating surface from the anode. Upon conducting current between the anode and cathode, a metallic coating is deposited specifically and selectively on a work surface or surfaces which are not covered by the shield member.

5 Claims, 15 Drawing Sheets

METHOD AND APPARATUS FOR PARTIALLY PLATING WORK SURFACES

TECHNICAL FIELD

This invention relates to a method and an apparatus for partially plating work surfaces, suitable for use in depositing a metallic coating selectively on a specified part of work surfaces to impart thereto particular properties, for example, improved properties as a sliding surface, enhanced resistance to abrasive wear and so forth, while preventing deposition of a metallic coating on other parts of the work surfaces.

PRIOR ART

For example, for a piston which is put in sliding movements within a cylinder, it has been known in the art to employ aluminum or an aluminum alloy as a base material from the standpoint of weight reduction and to plate surfaces of the piston with Fe, Fe—Cr alloy, Cr, Ni or the like for improvements of sliding properties and resistance to abrasive wear, e.g., from Japanese Laid-Open Patent Application 2001-41008.

In this connection, in addition to sliding surfaces areas to be held in sliding contact with inner surfaces of a cylinder, a piston usually has a surface area or areas on which a seal member is to be fitted on. For fitting a seal member on a piston, an annular groove is provided around the circumferential surface of the piston at one or a plural number of positions in the axial direction. The annular groove is so arranged as to retain a seal member therein. These seal fitting portions of a piston are kept out of contact with inner surfaces of a cylinder. Therefore, it is not necessarily required to plate the surfaces of the seal fitting portions. On the contrary, plating of seal fitting portions, which contain up and down surface irregularities due to existence of seal fitting grooves, can result in deposition of a coating of non-uniform thickness and unstable surface conditions as a result of changes in current density from one part to another. Therefore, seal fitting portions of a piston need precision machining to maintain certain surface accuracy. Taking these factors into consideration, in plating exterior surfaces of a piston for the purpose of improving its resistance to abrasive wear, it is desirable to limit the plating to the sliding surfaces areas, excluding the seal fitting areas and other surface areas from treatments.

For this purpose, for example, it has been the general practice to mask a non-plating surface area of a work by bonding a masking tape before immersing the work in a plating bath to deposit a coating of a predetermined thickness selectively and partially on limited surface areas of the work. After plating, the masking tape is removed from the work to obtain a partially plated product with a metallic coating deposited only on specified surface areas.

Preparatory treatments in a plating process usually include degreasing, pickling, alkali etching, acid activation, and zinc replacement, each followed by a rinsing treatment to wash treated surfaces with water. Therefore, in addition to a plating bath, a work is successively immersed in treating baths for the above-mentioned preparatory treatments. In order to partially plate work surfaces, a masking tape is bonded on a work before prior to the preparatory treatments, that is to say, a work is immersed in each treating bath in a masked state in the multiple preparatory treatment stage. This means that the masking tape is also immersed in various treating baths along with the work and each time wetted with a treating liquid in each treatment. Each preparatory treatment is followed by a rinsing treatment to wash off a deposited treating liquid from the masking tape.

However, since a masked surface area is elevated from an unmasked or exposed surface area of a work in the fashion of a relief, a treating liquid tends to remain and linger in corner portions around raised marginal edges of a masking tape, and in some cases the rinsing treatment fails to completely wash off the lingering treating liquid from the corner portions. If a work in such a state is introduced into a plating bath, a drying mark of a remained treating liquid comes out at the boundaries between the masked and unmasked surface areas of the work in a drying stage subsequent to a plating stage. Such drying marks, i.e., streaks of impurity or contaminant substances, which appears at the boundaries of partially plate surface areas not only impair the appearance of a product but also give rise to a structural problem such as development of corrosion.

Besides, the jobs of manually putting on and off masking tapes for each work are troublesome and time consuming. Further, a boundary line of a deposited coating layer can be disturbed by the way how a masking tape is put on. Furthermore, since a plated surface area is raised from a surface area from which a masking tape has been removed, there is a possibility of the deposited coating layer being destructed or peeled off by collision against other objects. Besides, it is difficult to bond a masking tape correctly in a case where there are bumpy surface irregularities in boundary regions of partial plating.

SUMMARY OF THE INVENTION

In view of the foregoing situations, it is an object of the present invention to provide a method and an apparatus for partially plating work surfaces, realizing precision partial plating by the use of a non-contacting shield member adapted to cover non-plating surface areas of a work.

It is another object of the present invention to provide a method and an apparatus for partially plating work surfaces, permitting to deposit a metallic coating selectively and precisely within bounds of a specified surface area or areas of a work.

It is still another object of the present invention to provide a method and an apparatus for partially plating work surfaces, permitting to carry out a plating process in an efficiently manner by simplification of pretreatments and post-treatments.

In accordance with the present invention, the above-stated objectives are achieved by the provision of a method for partially plating work surfaces, which comprises the steps of: placing a shield member around and in small gap relation with a non-plating surface area of a work connected to a cathode; immersing the work in a plating bath with an anode located on the outer side of the shield member; conducting current between the anode and cathode to deposit a metallic coating selectively on a specific work surface area or areas uncovered by the shield member.

According to the present invention, there is also provided an apparatus for partially plating work surfaces, which comprises: a plating bath; a hanger adapted to hold a work in an immersed position in the plating bath and to electrically connect the work to a cathode of a power supply; and a tubular shield member provided on the support means in such a way as to circumvent the work, in non-contacting small gap relation with a non-plating surface of the work to cover the non-plating surface from an anode plate in the plating bath.

By conduction of current between an anode and a cathode which are located in parallel positions within a plating bath, a metallic coating is deposited on the side of the cathode. At this time, a coating of uniform thickness is formed in case current density between the anode and cathode is constant. If a shielding object is placed between the anode and the cathode, current takes a by-pass route around the shielding object. In a case where the cathode is partly covered by a shielding object, the current density in a cathode portion which confront the shielding object distinctively differs from that of a cathode portion which directly confronts the anode. If the shielding object is located closer to the cathode, no current flows to some part of the cathode. If the shielding object is placed face to face and in small gap relation with the cathode, for example, leaving a gap space of several millimeters therebetween, the thickness of a deposited coating gradually continuously decreases from and inward of a boundary of a shielded area covered by the shielding object, and no coating is deposited past certain marginal portions of the shielded area.

In consideration of the foregoing, a shield member is set around a work in small gap relation with the latter, in such a way as to expose work surface areas to be plated while covering non-plating surface areas of the work with the shield member. In so doing, the shield member is set in non-contacting state relative to the work. Therefore, when an assembly of the work and the shield member is dipped in a treating bath in various pretreatment stages of a plating process, a treating solution or liquid can be urged to flow down and back into a treating bath through the small gaps between the work and the shield member. The treating solution can be completely removed by immersing the assembly of the work and shield member in a rinsing bath. It follows that work surfaces can be cleaned completely free of impurities and contaminants before the work is introduced into a plating bath.

In a plating solution of a plating bath, as a cathode the work is located face to face with an anode. As a result of current conduction between the anode and the cathode, a metallic coating is deposited on work surfaces. Since part of the work is covered by the shield member which is set in small gap relation with the work, a transitional zone of a certain width is formed between an exposed plating work surface and a shielded non-plating work surface, namely, at the boundaries of a shielded work surface. In the transitional zone, the thickness of the deposited coating decreases continuously from a plated surface area toward and inward of a shield surface area. Further inward of the transitional zone, no coating is deposited on the work surface despite immersion in the plating solution. Thus, partial plating becomes feasible, for depositing a metallic coating selectively on a specific surface area of a work which needs plating. The shape of the shield member is determined in relation with the shape of plating or non-plating work surfaces. For example, in a case where a plating work surface and a non-plating work surface are separated by a horizontal or vertical boundary line, the shield member is located face to face with a non-plating surface area. In a case where a coating is to be deposited on a limited surface area which is surrounded by non-plating work surfaces, an opening is provided in the shield member at a confronting position relative to the plating surface area.

Broader the gap space between a work and a shield member, wider becomes the transitional zone at the boundaries of a shielded surface area, encompassing even those surface areas on which no coating should be deposited. On the other hand, if the gap width is of an extremely small value, say, smaller than 1 mm, the transitional zone becomes substantially as narrow as a line. However, with a smaller gap width between a work and a shield member, higher skills are required in setting the shield member exactly in an aligned position relative to the work, and it becomes difficult to mount and dismantle the work on and from a work support or mounter member. Nevertheless, for high precision partial plating, it may become necessary to diminish the gap width between a work and a shield member. Any way, normally the shield member is maintained out of contact with work surfaces. However, part of the shield member may be in contact with a work surface in a case where treating solutions in pretreatment stages can be completely removed from the contacting work surface by rinsing the work in water.

More specifically, the transitional zone in partial plating becomes two wide if the gap width between a work and a shield member is wider than 5 mm. Therefore, the gap width between a work and a shield member should be smaller than 5 mm, and preferably between 2 mm and 5 mm.

In the course of a partial plating process, a shield member is used in a plating stage alone. Therefore, if desired, a shield member may be preset in a predetermined position within a plating bath where it can cover a predetermined part of work surfaces when a work is introduced into the plating bath. However, in an actual plating process, it is the general practice to prepare a work by a multiple pretreatment and to immerse the work in a plating bath immediately after completion of pretreatments. For this purpose, a work is supported on a hanger, which is transferred by a transport means to introduce the work successively into treating baths in a multiple pretreatment stage. In this manner, a work which is supported on a hanger is prepared in a plural number of pretreatment baths before introduction into a plating bath, and, after the plating bath, sent to a post-treatment stage for post-treatments including rinsing in a water bath. Each time when the hanger is lifted from a treating bath in the multiple pretreatment stage, the treating solution of the bath should be drained off the hanger and off the work and the shield member as well, because otherwise the treating solution would be carried away with the hanger and the work to contaminate treating solutions in the succeeding treating baths and a plating solution in the plating bath. Therefore, some measures should be taken to urge draining of a treating solution drain each time when the hanger and work are lifted up from a treating bath, for preventing the hanger from carrying out a treating solution from a treating bath and bringing it to a succeeding treating bath. For this purpose, it is desirable to mount a work and a shield member in a tilted posture on a hanger so that, when the hanger is lifted up from a treating bath, almost all of scooped treating solution or plating solution is urged to flow down along inclined surfaces of the work and shield member and get back to the treating bath without being carried out and brought into a succeeding treating bath.

The shield member may be fixedly provided on a hanger, or alternatively it may be detachably set on a hanger if desired. Any way, a work is set at a predetermined position on a hanger to let the shield member function as a masking member to a satisfactory degree. After plating, the plated work is dismantled from the hanger and a fresh work is set on the hanger. At the time of mounting a work on a hanger and dismantling a plated work from a hanger, there is no need for bonding a masking tape on a work surface or peeling off a masking tape from a plated work.

It is desirable that a work is supported on and carried by a hanger through the entire line of the plating process, from an initial step of a multiple pretreatment stage to the end of a post-treatment stage. For this purpose, work contact points are provided on the side of a hanger. As soon as the hanger is introduced into a plating bath, these contact points are connected to the cathode of a power supply. That is to say, the contact points are connected to the cathode only when the hanger is immersed in a plating bath. Therefore, the hanger is made of a conducting material, and desirably provided with a rod-like conductive member which is extended out of the plating bath and connected to the cathode of a power supply. The work contacting points may be provided on hooks or the like which also function as work holder means. The shield member may be of a conductive material as long as it is electrically insulated from the current-carrying hanger. However, it is desirable that the shield member is made of an electrically insulating material.

With regard to the shape of a work to be plated, there is no limitations in particular. More particularly, a work to be employed for partial plating may be almost any shape. For example, a metallic coating can be deposited on a specific surface area of a work which is in the shape of a flat plate, a square rod, a circular or elliptical column or cylinder, a tube or the like. In a case where there are up and down surface irregularities on a work surface, the irregular surface portion can be utilized as a border of a plating surface area. In a non-plating surface area, it is necessary to control the shield position to maintain a gap of a small width between a work and the shield member. In this regard, it is very important to keep the shield member in an aligned state relative to a work and also in a stabilized state while being transported from one treating bath to another. Furthermore, after plating, it becomes necessary to replace a plated work by a fresh one.

In case an importance is put on the alignment of a shield member with a work, it is desirable for the shield member to be fixedly supported on a hanger which is arranged to permit adjustments of a work position. On the other hand, in order to facilitate mounting and dismantling of a work onto and from a hanger, it is desirable for both work and shield member to be removably supported on a hanger. In this case, after plating, both a work and a shield member are removed from a hanger, and a fresh work is set on the hanger, making adjustments for alignment with a shield member. A work and a shield member on a hanger can be brought into alignment with each by adjusting positions relative to each other or relative to the hanger.

In summary, it suffices to cover a non-plating surface of a work with a shield member. Therefore, it is not necessarily a requisite for a shield member to be constituted by a single structure. In other words, there may be employed a separable or split type shield member for partial plating. For example, a shield member which is separable into right and left parts may be provided on a hanger in such a way that the two separable parts are initially put in open positions and, after setting a work in position, the two parts are closed toward each other and around the work to cover a non-plating surface area or areas of the work completely.

The above and other objects, features and advantages of the present invention will become apparent from the following description, taken in conjunction with the accompanying drawings which show by way of example some preferred embodiments of the invention. Needless to say, the present invention should not be construed as being limited to particular forms shown in the drawings.

BEST MODE FOR CARRYING OUT THE INVENTION

Figure 1:
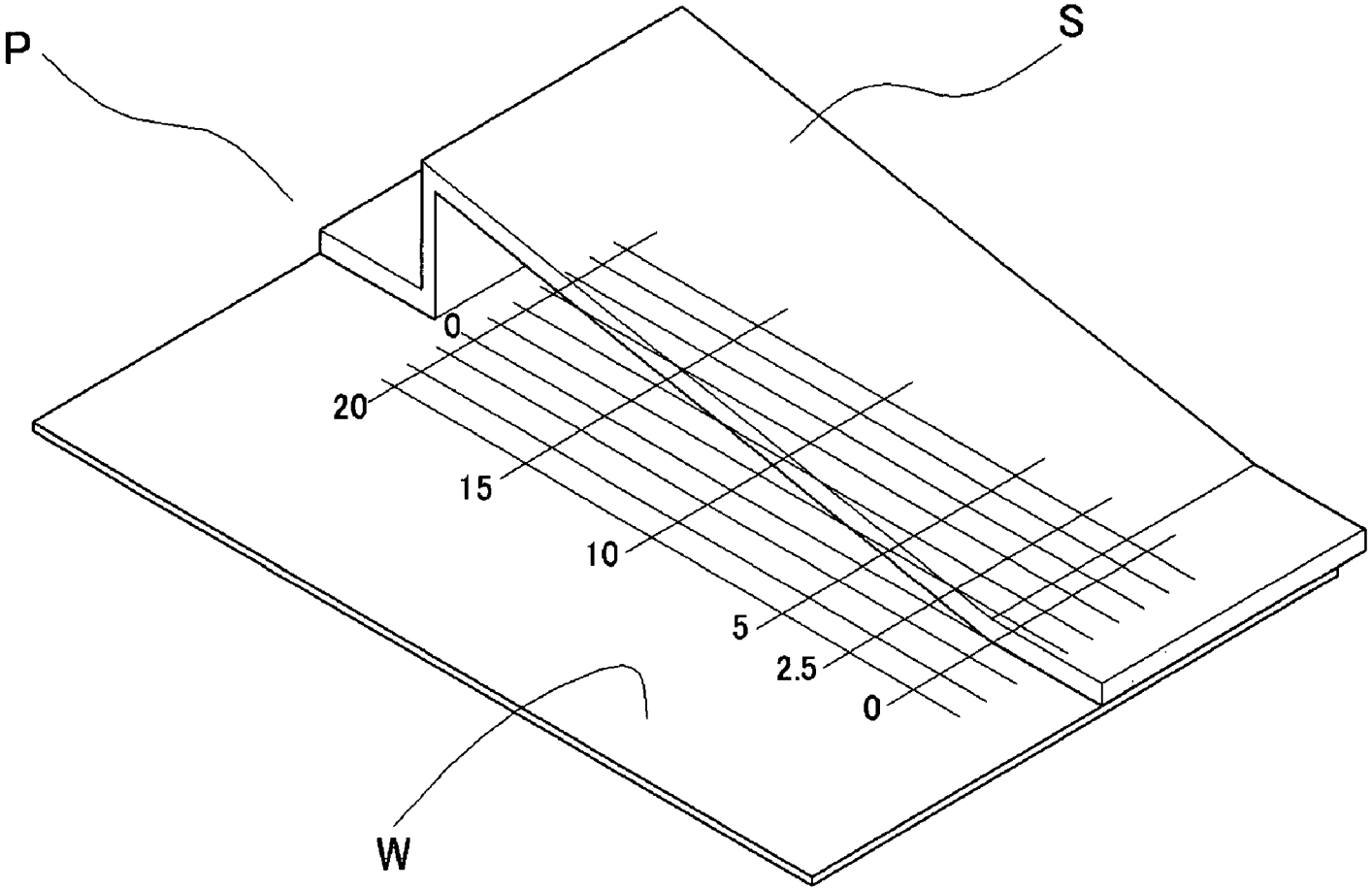
FIG. 1 is a schematic illustration of an evaluation jig used for evaluation of the partial plating according to the present invention.

Firstly, in a partial plating test, a plating specimen P was prepared as shown in FIG. 1, setting a shield member S on a flat metal plate W (e.g., a flat aluminum plate) to be plated, in face to face relation with a plating surface of the metal plate W. The shield member S was made of an electrically insulating material, and formed in a plate-like shape having a predetermined width (larger than 30 mm) and a uniform thickness. One end of the shield member S was fixed to the metal plate W, and lifted off the metal plate W by a vertical riser wall, for example, setting the shield member S at a space of 20 mm from the metal plate W. From that maximally spaced position, the spacing between the metal plate W and the shield member S was gradually narrowed down toward the other end of the shield member S which was also fixed to the metal plate W. In FIG. 1, the spacing between the shield plate S and the metal plate W is indicated by a graduated scale from 20 mm to 0 mm. Graduations in the longitudinal direction indicate distances from outer to inner side of the shield plate S at intervals of 5 mm.

After setting plating conditions, including type of electrolyte, distance from anode, current density, temperature, time length of immersion in the electrolyte, the metal plate W of the plating specimen P was connected to the cathode and the plating specimen P was positioned face to face with the anode to start plating.

Figure 2:
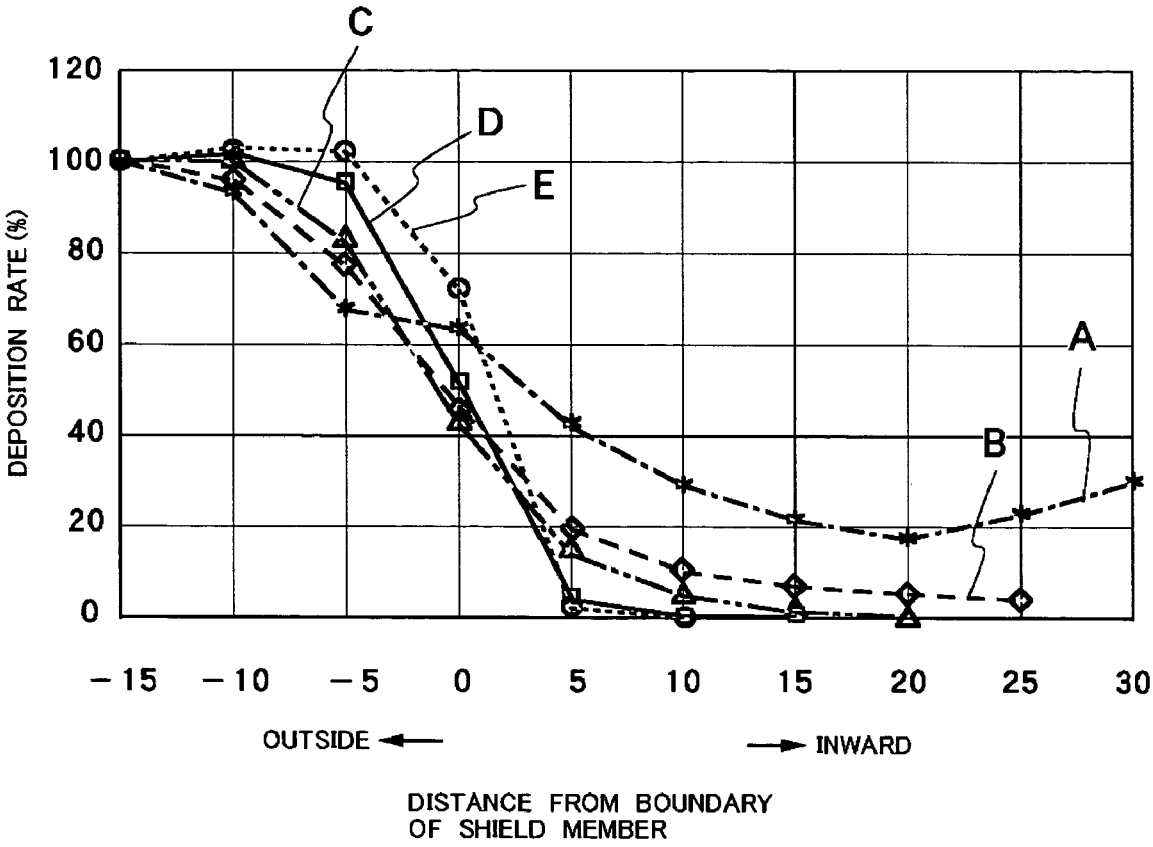
FIG. 2 is a diagram showing variations in thickness of a coating deposited in the vicinity of an end portion of a shield member, in relation with distances between the shield member and a work.
Figure 3:
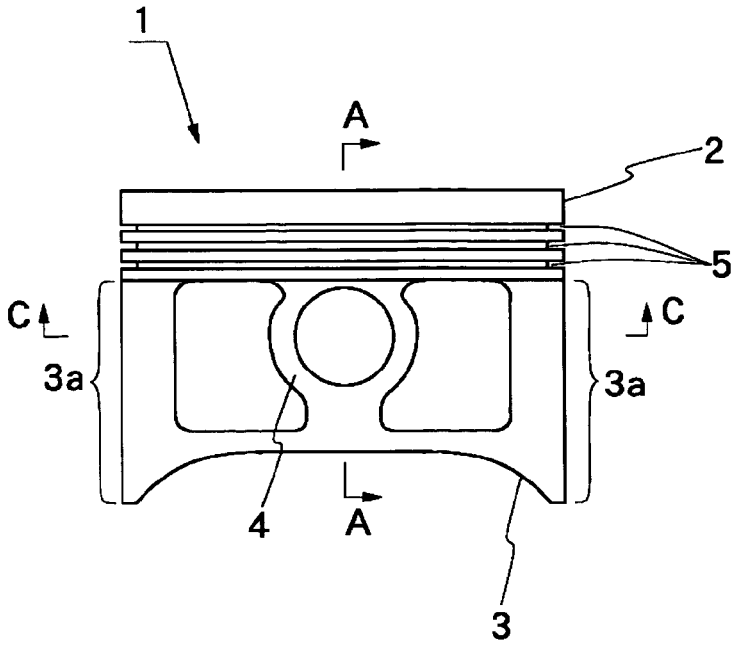
FIG. 3 is a schematic front view of a work adopted in the present invention.

The results are shown in FIG. 2. As clear from that figure, deposition rate varies across the shielded area depending upon the spacing between the shield member S and the metal plate P to be plated. As indicated by curve A plotting deposition rates at 20 mm spacing positions, approximately 20% higher deposition took place even at a position 20 mm inward of the boundary of the shield member S as compared with depositions in unshielded areas. Further, as indicated by curve B plotting deposition rates at 15 mm spacing positions, deposition took place only at a rate of several per cent at a position 20 mm inward of the boundary of the shield member S. Furthermore, as indicated by curve C plotting deposition rates at 10 mm spacing positions, deposition did not reach a 20 mm inner position on the shielded area. In the case of 5 mm spacing positions, as indicated by curve D, the thickness of deposition decreased from a position which was about 5 mm outside the boundary of the shield member S, and no deposition took place 5 mm inward of the boundary of the shield member S. Furthermore, in a case where the spacing was as small as 2.5 mm, as indicated by curve E, the thickness of deposition abruptly dropped from a position about 5 mm outside of the boundary of the shield member S and no deposition took place at a position 5 mm inward of the boundary of the shield member S.

Gathering from the foregoing test results, partial plating is possible by the use of the non-contacting shield member S as long as the width of spacing between the shield member S and the metal plate W is smaller than 5 mm. It is more preferable to use the shield member with a spacing of approximately 2.5 mm and to deposit a coating of approximately 1.5 μm. Across a transition zone which is approximately as wide as 10 mm, the coating thickness gradually and continuously decreases from a plated area to a non-plated area.

Embodiments 1

Now, description is directed to a first embodiment of the invention, with reference to FIGS. 3 to 10. In the following description, by way of example the partial plating of the present invention is applied to a piston 1 of an automobile reciprocating engine to plate only sliding surface areas of the piston. However, needless to say, the present invention is not limited to a work of this sort.

Shown in FIGS. 3 to 6 is the construction of the piston 1 adopted for partial plating. As seen in these figures, the piston 1 is generally in the shape of a lidded round tube, including a piston crown 2, a skirt portion 3, and a boss portion 4 to which a piston pin (not shown) is to be connected. Formed around the outer periphery of the piston crown 2 are a plural number of annular piston ring grooves 5 in series in the axial direction. A piston ring is fitted in each one of these piston ring grooves 5. As the piston 1 is reciprocated within a cylinder, a connecting rod which is connected to the piston pin on the boss portion 4 is moved up and down.

Figure 4:
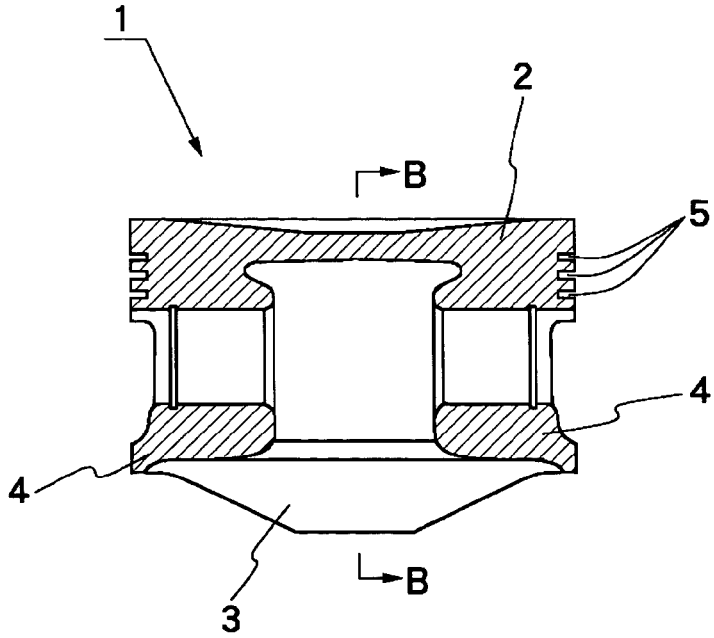
FIG. 4 is a schematic sectional view taken on line A-A in FIG. 3.
Figure 5:
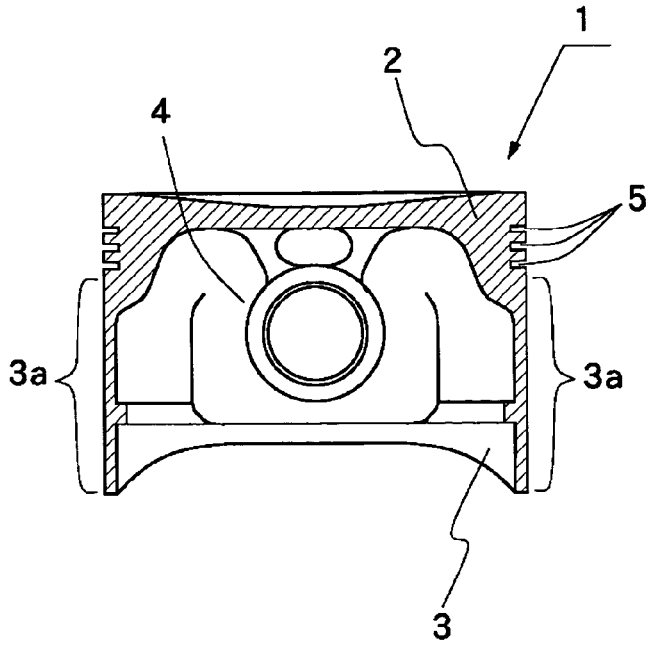
FIG. 5 is a schematic sectional view taken on line B-B in FIG. 4.
Figure 6:
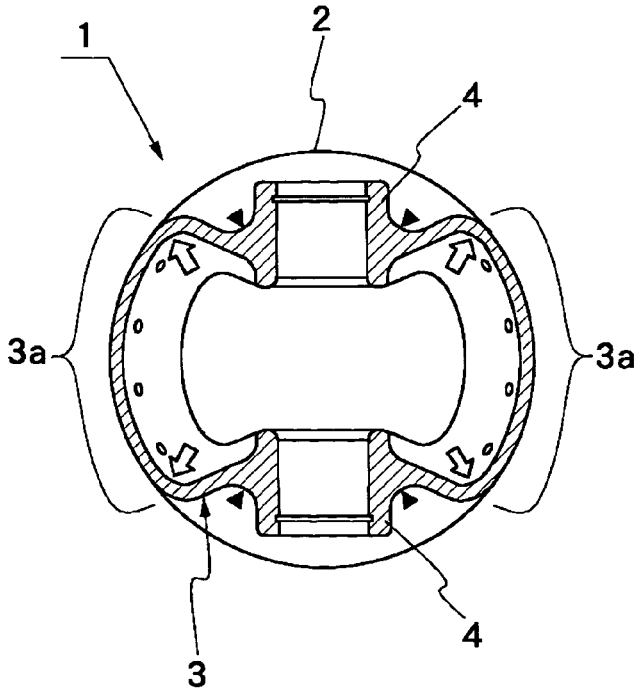
FIG. 6 is a schematic sectional view taken on line C-C in FIG. 3.

Of the various parts of the piston 1 mentioned above, the piston rings which are fitted in the piston ring grooves 5 and the skirt portion 3 are held in sliding contact with the cylinder. Namely, as far as the main body of the piston 1 is concerned, it is only the skirt portion 3 that is held in sliding contact with the cylinder. More precisely, in order to reduce sliding resistance, sliding surfaces 3*a* on the skirt portion 3 are limited to certain angular or segmental sections on the opposite sides of the boss portion 4 as shown in FIG. 4.

For the sake of weight reduction, the body of the piston 1 itself is made of aluminum or an aluminum alloy, and an iron coating (or an iron-chromium alloy coating) is plated on the sliding surfaces 3*a* on the skirt portion 3 of the piston 1 to enhance the resistance to abrasive wear. However, the partial plating excludes the boss portion 4 which will receive a piston pin, as well as the piston crown 2 which is formed with piston ring grooves 5, for maintaining the finish accuracy of these piston portions with complicate shapes. That is to say, the partial plating is limited to the sliding surfaces 3*a*. For partially plating the piston 1, non-plating surface areas need to be masked. For example, a hanger 10 as shown in FIGS. 5 to 8 can be employed for partially plating the piston 1.

Figure 7:
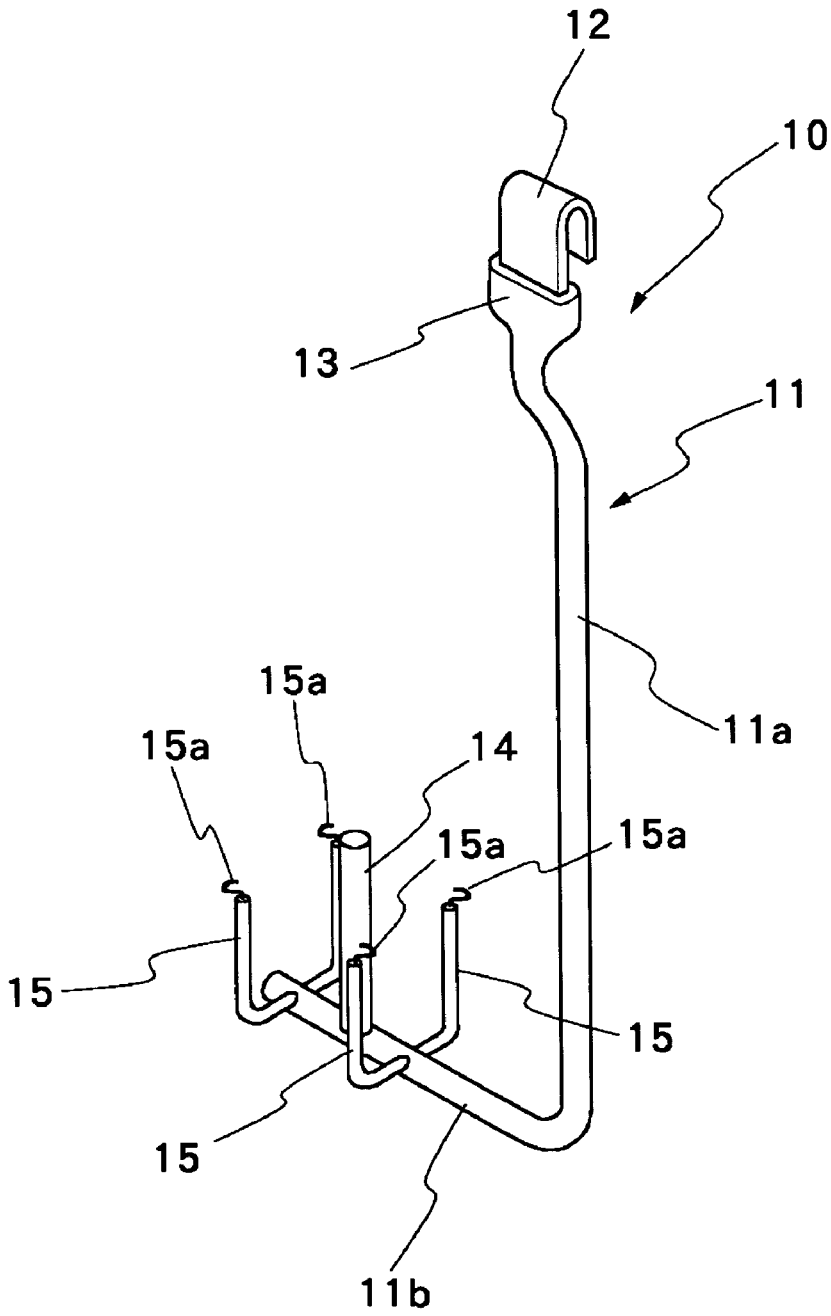
FIG. 7 is a schematic outer view of a hanger employed in a partial plating treatment in Embodiment 1 of the present invention.

As shown particularly in FIG. 7, the hanger 10 has a generally L-shaped hanger body proper 11. Provided at the top end of the hanger body 11 is a hook portion 12 which, in addition to functions as a hook, serves as a power supply contact point. The hook portion 12 is hooked on a rod member 30 (FIG. 9) of a transfer means, which is adapted to repeat an operation of feeding the hanger 10 pitch by pitch in the forward direction and an operation of lifting the hanger 10 up and down to deliver same successively to pretreatment baths, plating bath and post-treatment baths. The hanger body 11 is composed of a vertical hanger rod portion 11*a* and a mounter rod portion 11*b* which is formed by bending a lower end portion of the vertical hanger rod portion 11*a* approximately through 90 degrees. Since piston ring grooves are provided on the piston crown 2, various solutions in treating baths as well as plating solution can be carried out by the piston 1. In order to prevent this carry-out problem, it is desirable to make arrangements to hold and retain the piston 1 in a tilted state. For this purpose, for example, arrangements may be made such that the hanger body 11 is tilted to a certain degree when the hook portion 12 is hooked on the transfer rod 30. Otherwise, the angle between the vertical hanger rod portion 11*a* and the mounter rod portion 11*b* may be adjusted in such a way as to tilt the piston 1 on the mounter rod portion 11*b* to a suitable degree. The hanger body 11 is made of a conducting metal, and encased in an insulating tube 13.

Erected on the mounter rod portion 11*b* of the hanger body 11 is a support post 14 to be abutted against the lower side of the piston crown 2. Preferably, the support post 14 is constituted by a rod member of an electrically insulating material, and serves to sustain the load of the piston 1. Further, four L-shaped angular electrode rods 15 are provided on the mounter rod portion 11*b*, in laterally projected positions on the front and rear sides of the support post 14. Base ends of these electrode rods 15 are connected to the hanger body 11 in an electrically conductive state. Except tip end portions, the electrode rods 15 are encased in an insulating tube 13. Tip end portions of the electrode rods 15 are exposed and provided with arcuately curved spring electrodes 15*a*.

As soon as a piston 1 is put on the hanger 10, the support post 14 is abutted against the lower side of the piston crown 2 to sustain the load of the piston 1 from beneath. The spring electrodes 15*a* at the top ends of the electrode rods 15 are located at lower positions as compared with the upper end of the support post 14, and the electrode rods 15 are arranged to come into abutting engagement with inner surfaces of the skirt portion 3 of the piston 1. Besides, as indicated by arrows in FIG. 6, each one of the four spring electrodes 15*a* is biased to abut against an inner surface of the skirt portion 3 in transitional regions from an arcuate segmental section with the sliding surface 3*a* to a boss portion 4. In a case where the electrodes 15*a* are abutted on the outer peripheral side of the piston 1, it is desirable to bring the respective electrodes 15*a* into abutting engagement with the piston 1 at the positions marked with "▲" in FIG. 6. The spring electrodes 15*a* are pressed against the inner surface of the piston 1 in such a way as to hold the piston 1 stably at a predetermined position.

Figure 8:
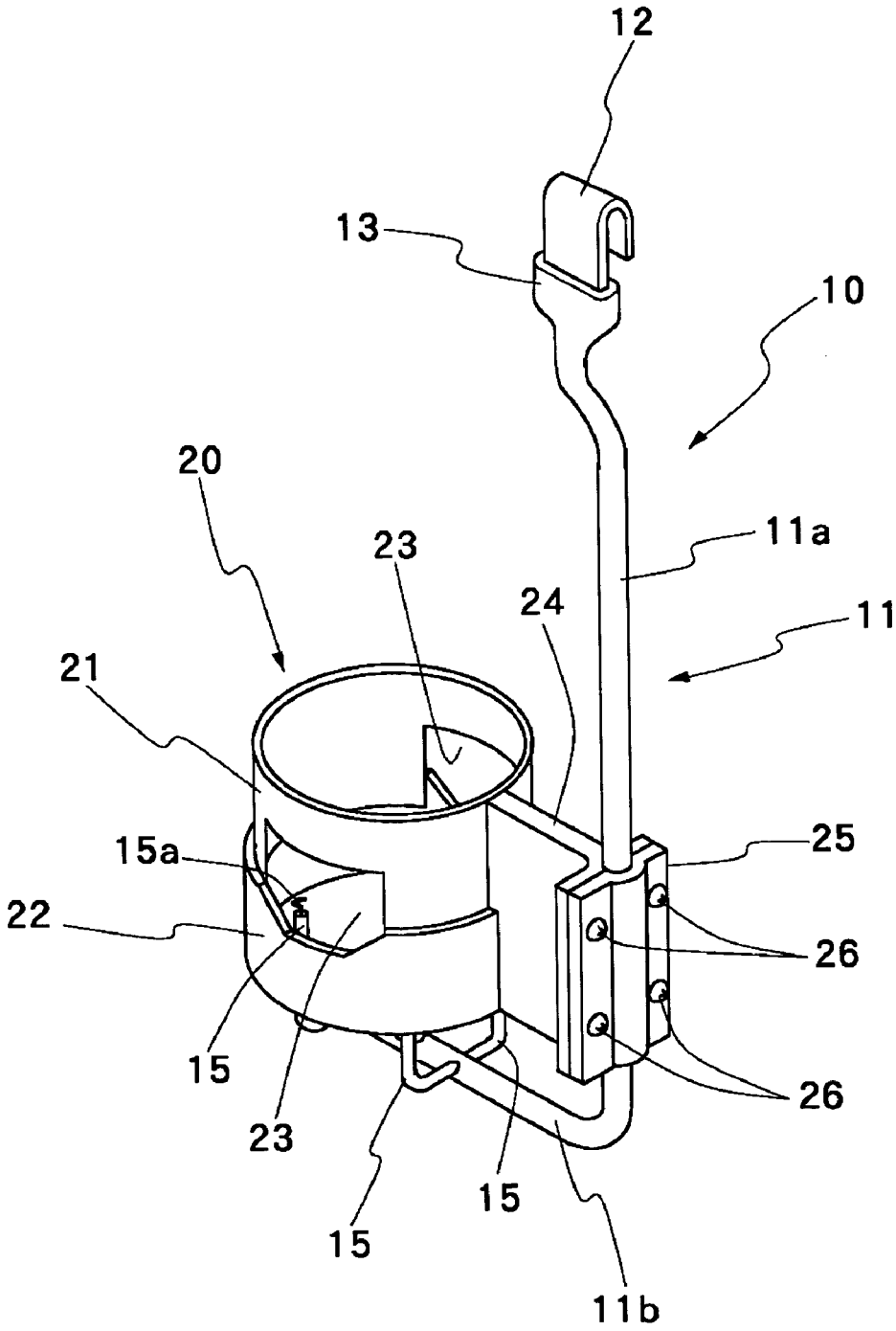
FIG. 8 is a schematic outer view of a shield member which is set on the hanger of FIG. 7.

Further, as shown in FIG. 8, a shield member 20 is attached to the outer periphery of the insulating tube 13 encasing the vertical hanger rod portion 11*a* of the hanger body 11. The shield member 20 is composed of upper and lower tubular enclosures 21 and 22. The upper tube 21 is fitted in the lower tube 22 to a predetermined extent, and fixed in that position by the use of an adhesive or the like. In this instance, the shield member 20 is separable into the upper tube 21 and the lower tube 22 and provided with openings 23 at opposite lateral sides to expose the sliding surfaces 3*a* on the skirt portion 3. The shield member 20 is not necessarily required to be a split type. Namely, the shield member 20 may be constituted by a single tubular structure which is provided with openings at opposite lateral sides similarly to the opening 23. Approximately T-shaped connecting arm 24 is extended out from the outer periphery of the shield member 20, and a clamp plate 25 is fixed to the outer end of the connecting arm 24 by a plural number of screws 26 in such a way as to firmly grip the insulating tube 13 of the hanger body 11 therebetween. In this regard, the shield member 20 may be of any material because it is electrically insulated from the hanger body 11 by the insulating tube 13. However, it is desirable that the shield member 20 is a synthetic resin molding.

Figure 9:
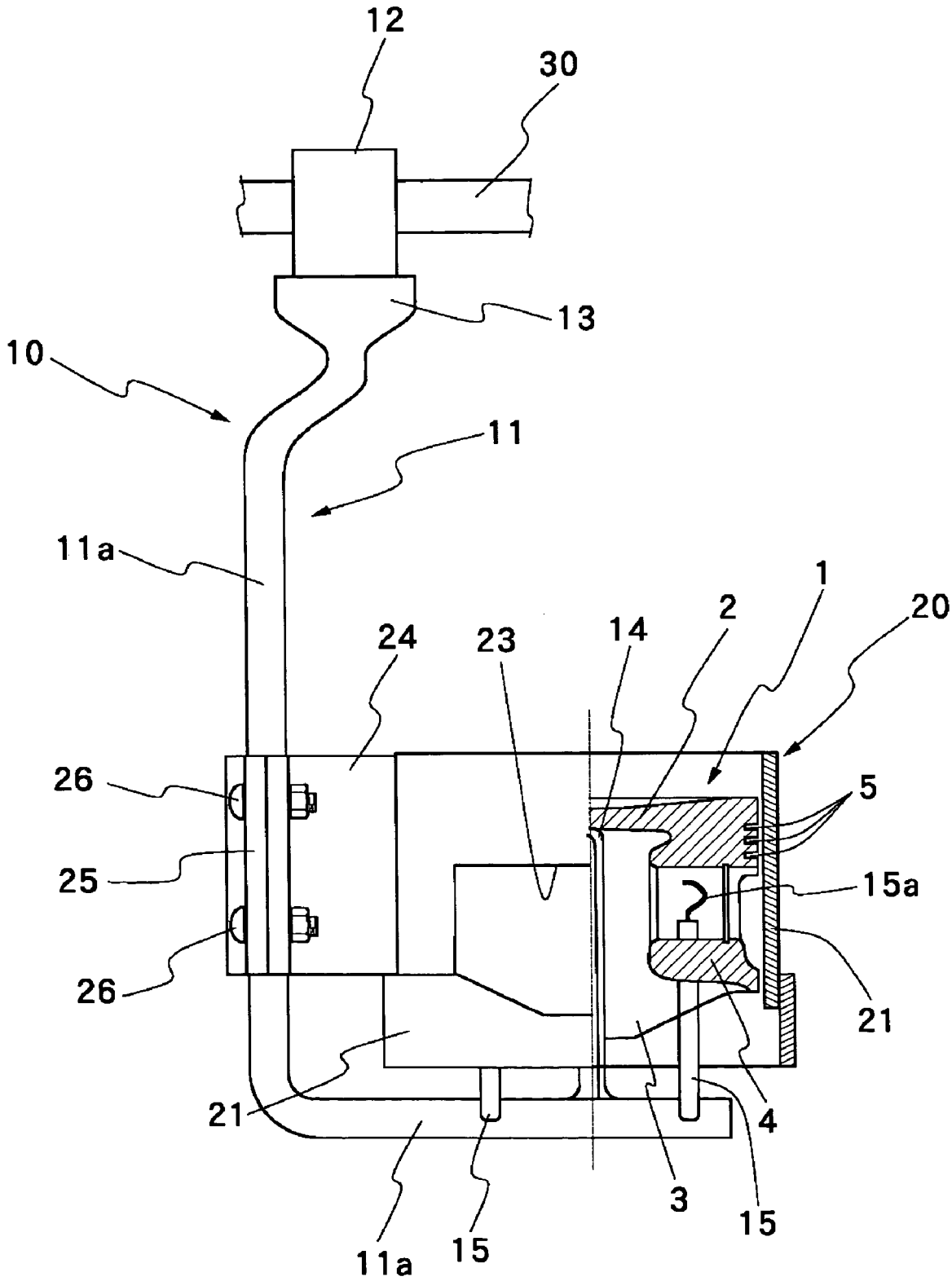
FIG. 9 is a partly cutaway front view of the shield member and a piston which is set on the hanger as a work.

Even in the case of partial plating, it is necessary to prepare plating surfaces by pretreatments. For example, for pretreatment of a plating surface, it is the general practice to treat work surfaces successively in a multiple pretreatment stage, including degreasing, rinsing, pickling, rinsing, alkali etching, rinsing, acid activation, rising, zinc replacement, rinsing, pickling, rinsing, zinc replacement and rinsing. Therefore, in order to carry out these pretreatments, a work is successively dipped in baths which are filled with the respective treating solutions. The afore-mentioned transfer means for the piston 1 is provided over a series of treating baths, and, as shown in FIG. 9, the piston 1 is hooked on a hanger transfer rod 30 of the transfer means which is adapted to lift the piston 1 up and down in combination with pitch by pitch forward feed actions. In this respect, in order to hold the hanger 10 in a stabilized state, the hanger transfer rod 30 is preferred to be of a square shape in cross-section.

Figure 10:
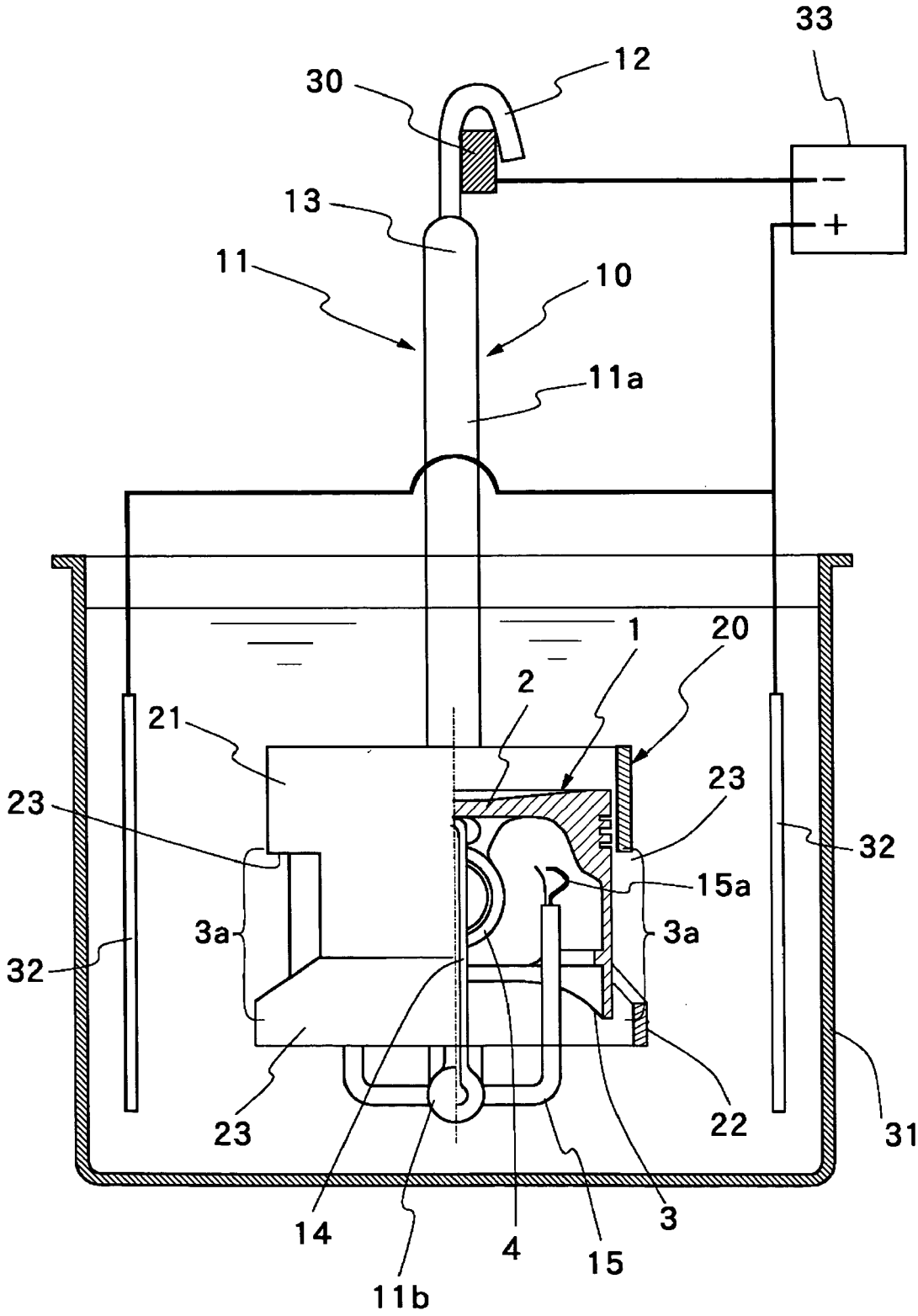
FIG. 10 is a partly cutaway schematic view of the piston undergoing a partial plating treatment in Embodiment 1.

After the above-mentioned pretreatments, iron is plated on the sliding surfaces 3*a* of the piston 1 in a plating bath 31 as shown in FIG. 10. The plating bath 31 is filled with an electrolyte, and anode plates 32 are immersed in the bath. Over the plating bath 31, the square hanger transfer rod 30 is located between the anode plates 32. The anode plates 32 are connected to the anode of a direct-current power supply 33. The cathode is electrically connected to the hook 12 of the hanger 10 when the hanger transfer rod 30 is located over the plating bath 31. By current conduction between the anode plates 32 and the hanger transfer rod 30, an iron coating is deposited only on the sliding surfaces 3*a* on the skirt portion 3 of the piston as a result of partial plating. In the course of the partial plating, the piston 1 may be held in a still state, but it may be oscillated in vertical or lateral directions to complete the plating more efficiently.

Further, after plating the sliding surfaces of the piston 1, the work is passed through post-treatment stages including rinsing, tin plating, rinsing and drying. In this instance, the post-treatments include tin plating of iron plated surfaces to put the sliding surfaces 3*a* in more fit conditions relative to the cylinder. However, the post-treatments may not be necessarily required to include tin plating.

Thus, the piston 1 is set on and carried by the hanger 10 from the start of the pretreatments till the end of post-treatments. That is to say, the piston 1 is set on the hanger 10 before starting pretreatments, and removed from the hanger 10 after the post-treatments. The shield member 20 which is assembled with the hanger 10 is open on the top side. Therefore, the piston 1 can be placed in position within the shield through the open top side of the latter. After completing a plating process, the piston 1 can be removed from the hanger 10 simply by lifting it up through the open top end of the shield member 20. Namely, the hanger 10 is arranged to leave the top side of the shield member in an open state for the purpose of facilitating mounting and dismantling of the piston 1 onto and from the hanger 10. Therefore, the piston 1 can be mounted onto and dismantled from the hanger 10 in an extremely facilitated manner. Besides, since there is no need for bonding a masking tape on non-plating portions of the piston 1 in a preparatory stage of the plating process as discussed in detail herein later, time and labor can be saved to a significant degree.

When the piston 1 is set in position on the hanger 10, it is retained in a non-contacting state relative to the inner surface of the shield member 20 which is assembled with the hanger 10, and its outer periphery is substantially uniformly spaced from the shield member 20. Since the shield member 20 is provided fixedly on the hanger 10, the piston 1 should always be in the same positional relations with the shield member 20 when set on the hanger 10. The support post 14 is abutted against the lower side of the piston crown 2, while the spring electrodes 15*a* are resiliently abutted against the inner side of the skirt portion 3 of the piston 1 at four separate points. In addition, since the spring electrodes 15*a* are located on the opposite sides of the inwardly projecting boss portion 4, the piston 1 is automatically oriented into a concentric aligned position relative to the shield member 20 as soon as it is placed on the hanger 10. Namely, the piston 1 is almost uniformly spaced from the shield member 20 all around its outer periphery. Besides, the piston 1 can always be set in the same direction relative to the shield member 20 and the hanger 10. Therefore, the sliding surfaces 3*a* on the skirt portion 3 of the piston 1 are always positioned face to face with the openings 23 in the shield member 20. That is to say, only the sliding surfaces 3*a* of the piston 1 are exposed through the openings 23, while the piston crown 2 and boss portion 4 of the piston 1 are covered in the shield member 20.

The hanger 10, with the piston 1 set in position in the above-described manner, is immersed in the plating bath 31, whereupon current conduction takes place between the anode plates 32 and the rod 30. At this time, current-carrying contact points are established between the hook 12 of the hanger 10 and the hanger body 11 and between each one of the electrodes 15*a* on the electrodes rods 15 and the piston 1. Thus, as a result of conduction through the piston 1, a metallic coating is deposited on outer surfaces of the piston 1. More specifically, a metallic coating of uniform thickness is deposited exclusively on the sliding surfaces 3*a* of the piston 1 alone. At this time, the entire body of the piston 1 is immersed in the electrolyte in the plating bath 31. The current density becomes higher at an edgy portion which exists in the transitional portion from the sliding surface 3*a* to the boss portion 4.

In this regard, it is the sliding surfaces 3*a* alone that are allowed to directly face an anode plate 32, and other portions of the piston 1 are intervened and covered by the shield member 20. As clear from FIG. 2, in a case where the piston crown with the piston ring grooves 5 is spaced, for example, 2.5 mm from the inner peripheral surface of the upper tube 21 of the shield member 20 to deposit a coating of about 15 μm in thickness, the deposition continuously decreases in a transitional zone of about 10 mm which intervenes a plated area and a non-plated area. Of course, the width of the transitional zone can be minimized by further narrowing the spacing between the piston and the shield member 20. However, in the case of a work like the piston 1, the existence of a transitional zone of the above-mentioned width will give rise to no problems in particular. Besides, in a case where the spacing is as wide as 2.5 mm, the piston 1 can be set on and off the hanger 10 quite easily. However, if there is a need for reducing the width of the transitional zone, the spacing between a work and the shield member may be narrowed as long as they are not in intimate contact with each other.

On the other hand, from the standpoint of facilitating mounting and dismantling of the piston 1, it is desirable to provide a spacing of about 5 mm. However, the wider the spacing, the wider becomes the transitional zone between plated and non-plated areas. In conclusion, particularly high precision partial plating is feasible when the spacing between the shield member 20 and a piston 1 is in the range between 2.5 mm and 5 mm.

Furthermore, in order to prevent current concentration at edgy portions between the sliding surface 3*a* and the boss portion 4 and at lower end portions of the sliding surface 3*a* and to distribute current uniformly over the entire sliding surfaces 3*a*, it is desirable to overlap side and lower portions of the shield member 20 partly by several millimeters on the sliding surfaces 3*a* to have substantially uniform current distribution over the entire sliding surfaces 3*a*. The extent of overlapping of the shield member 20 is determined suitably in consideration of shapes of the transitional portion from the sliding surface 3*a* to the boss portion 4 and of the lower end portion of the sliding surface 3*a*, that is to say, taking into account whether or not these portions contain edges or, in other words, whether or not these portions are rounded off.

As described above, the exterior surfaces of a work, the piston 1 in this case, are in a completely exposed state without contacting any other member, so that a treating solutions which are used in a pretreatment stage, for example, a treating solution in an acid or alkali treatment stage can be completely removed in a subsequent rinsing stage. Therefore, all of retreating solutions are removed completely form the work before introducing same into the plating bath 31 to undergo partial plating. It follows that the partially plated piston 1 is very satisfactory in appearance because it is free of deposition of impurities which would give rise to problems like corrosion.

Embodiment 2

Shown in FIGS. 11 through 17 is a second embodiment of the present invention. In the following description of the second embodiment, those component parts which are same as or equivalent with the counterparts in the foregoing first embodiment are simply designated by the same reference numerals or characters to avoid repetitions of the same explanations. In the case of the second embodiment, arrangements are made so that a work in the form of a piston 1 as well as a shield member 60 is removably set on a hanger 40. Besides, the piston 1 and the shield member 60 are set on the hanger in an inclined state, for example, with an inclination angle of 15 to 30 degrees relative to the hanger 40.

Figure 11:
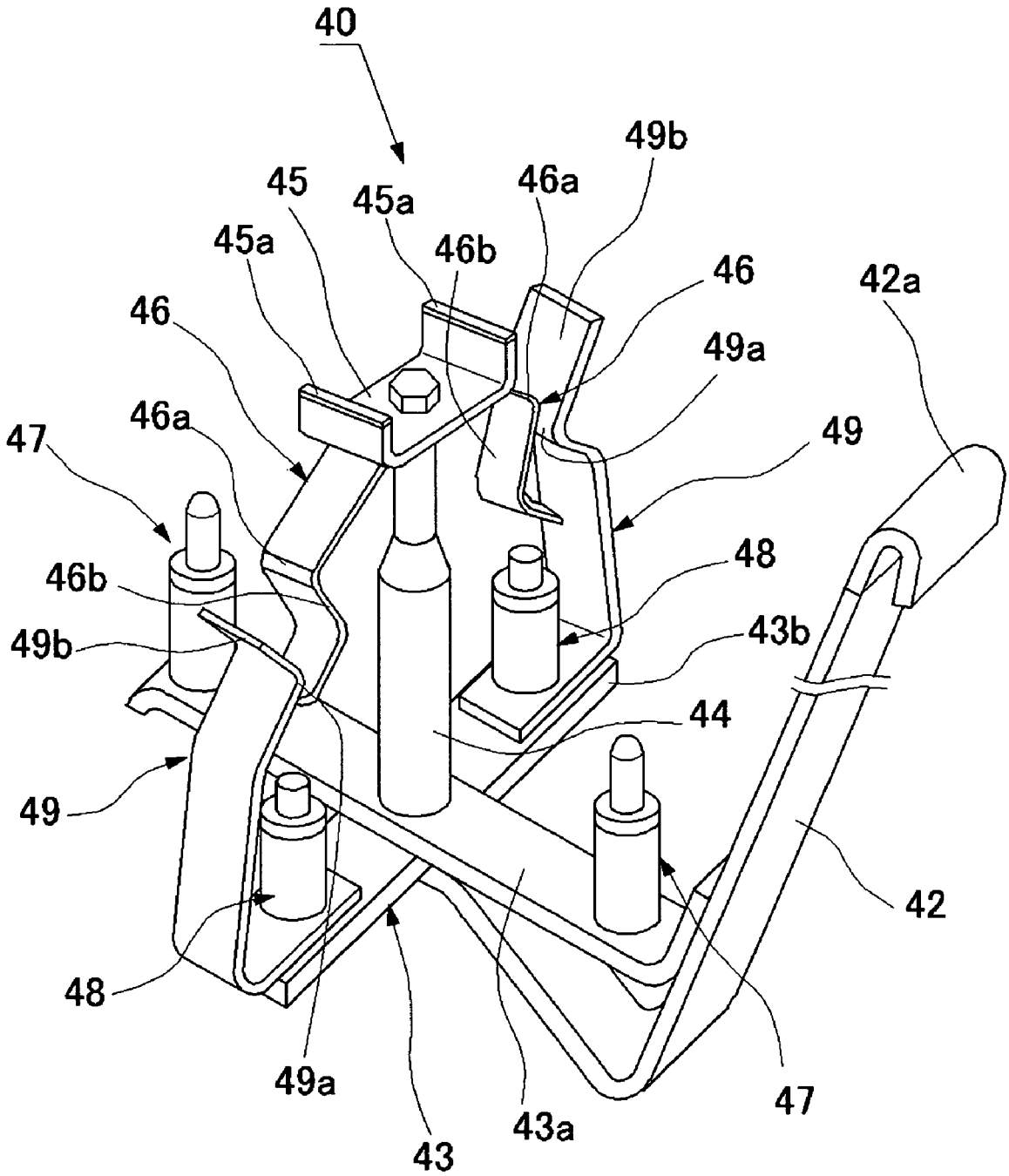
FIG. 11 is a schematic outer view of another hanger employed in a partial plating treatment in Embodiment 2 of the present invention.

Shown in FIG. 11 are details in construction of the hanger 40. The hanger 40 is largely constituted by a vertical hanger bar member 42 and a mounter member 43 which is connected to a lower end portion of the vertical hanger bar member 42. The mounter member 43 is provided with support strips 43*a* and 43*b* which are crossed at the lower end of the vertical hanger bar member 42. Similarly to the foregoing first embodiment, the vertical hanger bar member 42 is provided with a hook portion 42*a* at its top end, and the hook portion 42*a* is hooked on a hanger transfer rod of a transfer means, by which the work is fed pitch by pitch in the forward direction and lifted up and down at predetermined positions although not shown in the drawings.

Figure 12:
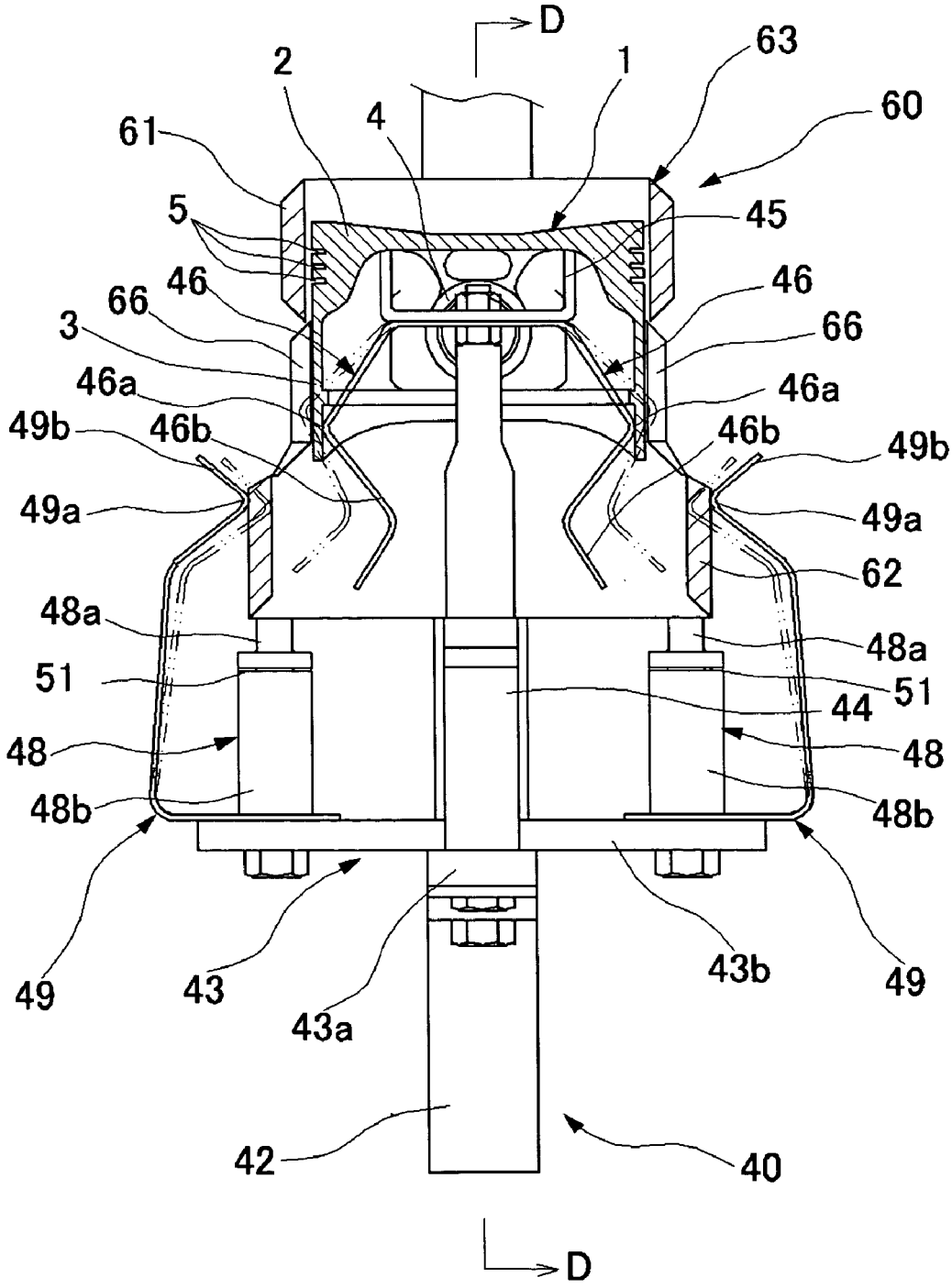
FIG. 12 is a sectional view of a shield member and a work which are set on the hanger of Embodiment 2.
Figure 13:
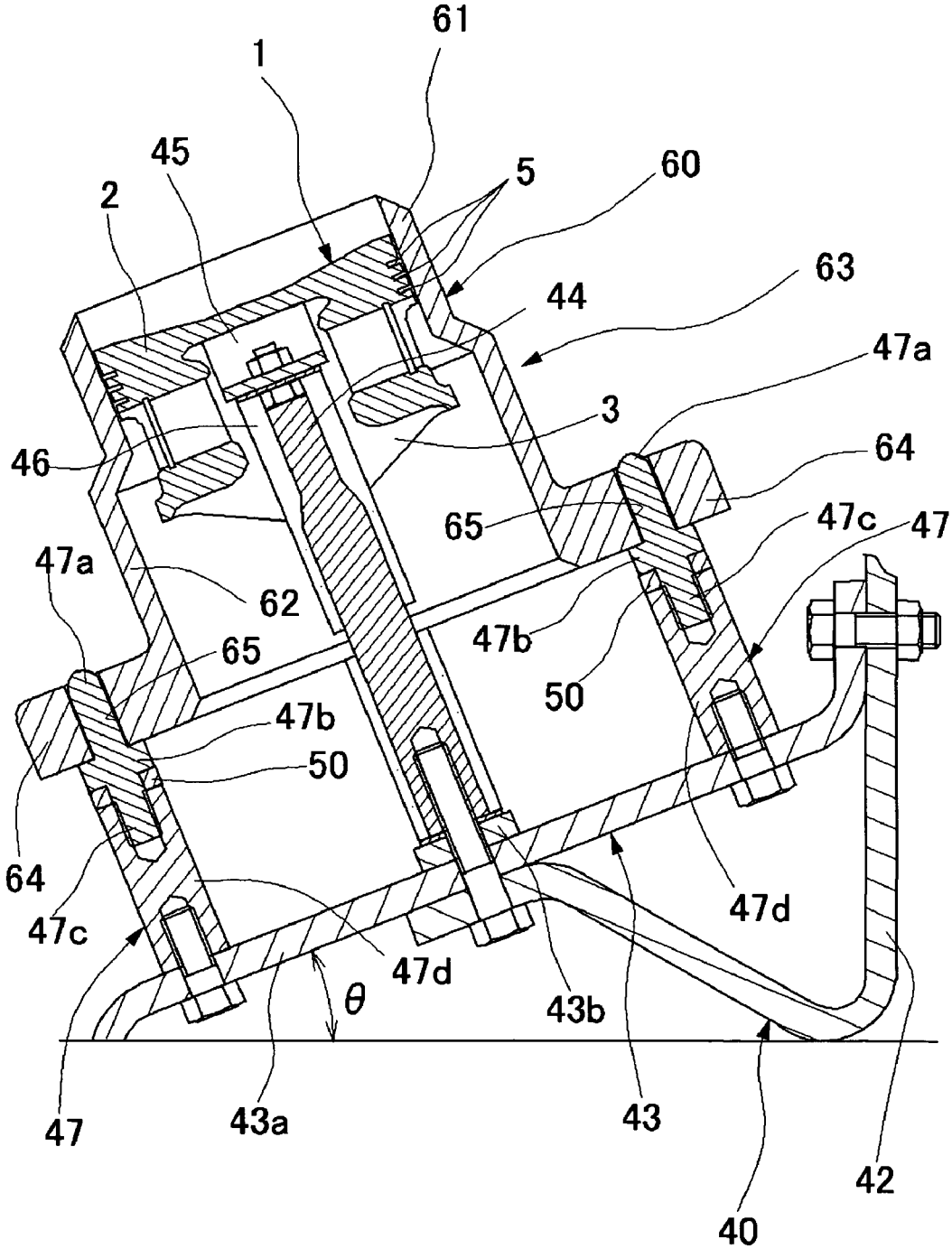
FIG. 13 is a sectional view taken on line D-D of FIG. 12.

As seen in FIGS. 12 and 13, a support post 44 is erected at the intersection of the support strips 43*a* and 43*b*. Provided at the top end of the support post 44 are a piston receptacle member 45, and a pair of piston retainer springs 46 which are provided opposingly at the opposite ends of the piston receptacle strip 45. The opposite ends of the piston receptacle strip 45 are bent at right angles, that is to say, are turned upward for abutting engagement with inner end face of the piston crown 2 of the piston 1. Each one of the piston holder springs 46 is constituted by a leaf spring which is extended obliquely downward away from an upper end portion of the support post 44 over a predetermined length, then bent obliquely inward toward the support post 44 and finally bent obliquely outward away from the support post 44, providing a shoulder portion 46*a* and an outwardly turned distal end portion 46*b*. The most projected shoulder portions 46*a* of the retainer springs 46 which serve as spring force exerting portions are pressed against inner surfaces of the skirt portion 3 of the piston 1. The outwardly turned end portions 46*b* function as an escape to avert the lower end of the piston 1.

Taking a look from the side of the vertical hanger bar 42, positioning/support pins 47 are erected on front and rear end portions of the support strip 43*a* which are extended in forward and rearward directions. Further, pedestal pins 48 are erected on opposite end portions of the support strip 43*b* which is extended in the transverse direction of the hanger. The shield member 60 is removably supported on the mounter member 43 of the hanger 40 by these support pins 47 and pedestal pins 48. Along with the pedestal pins 48, gripper leaf springs 49 are attached on opposite end portions of the support strip 43*b* thereby to clamp the outer periphery of the shield member 60 from outside. These gripper leaf springs 49 which rise upward from the support strip 43*b* are bent in the inward direction and then in the outward direction to provide angularly bent clamp portions 49*a* which are projected inward or toward each other for abutting engagement with the outer periphery of the shield member 60. Above the clamp portion 49*a*, each gripper leaf spring 49 is bent outward. Thus, the inwardly projected clamp portions 49*a* serve to clamp the outer periphery of the shield member 60 from opposite sides. Further, outwardly bent upper end portions 49*b* of the gripper leaf springs 49 serve as guide surfaces for the shield member 60, urging the latter into position inward of the gripper leaf springs 49.

Figure 14:
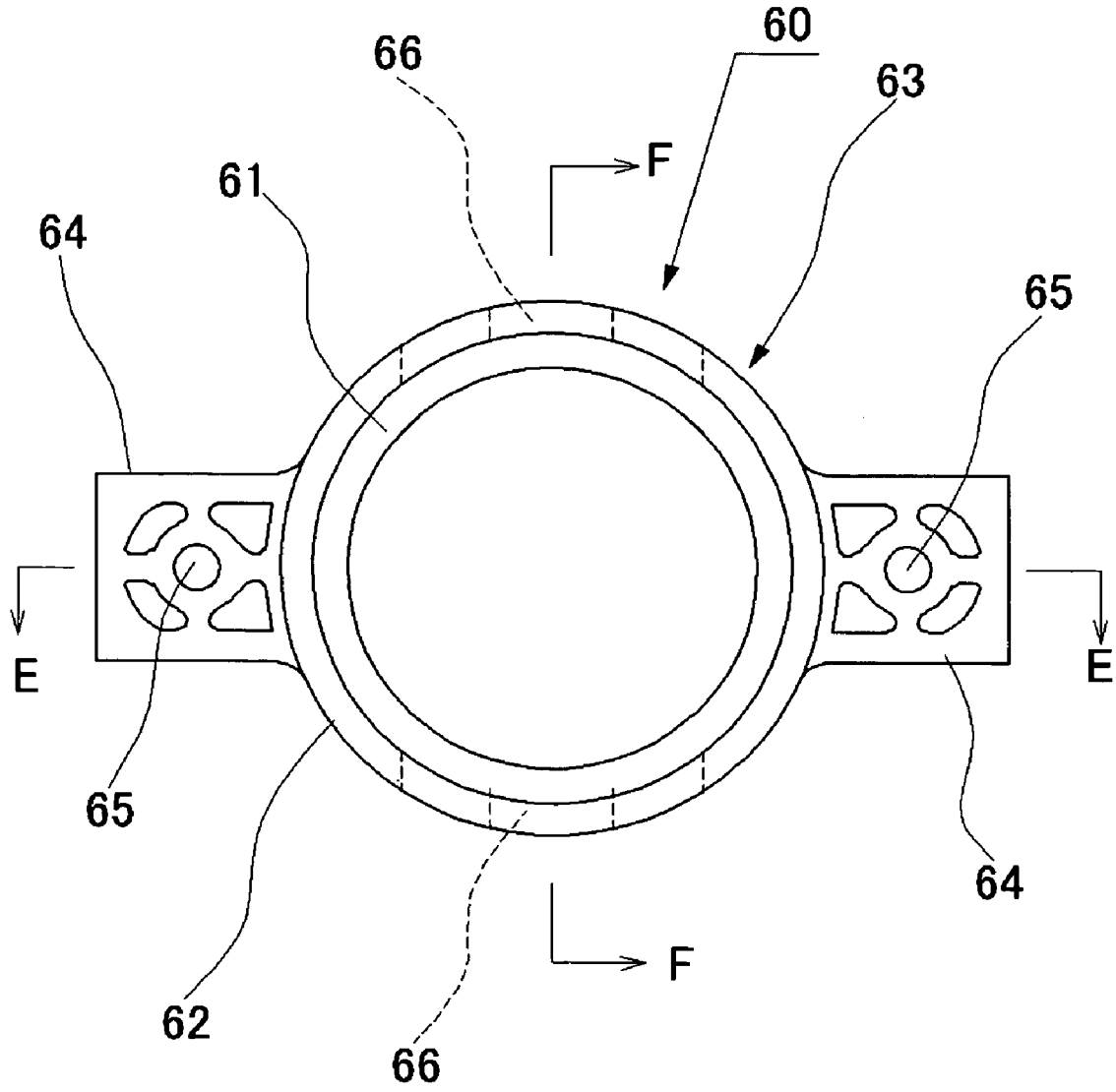
FIG. 14 is a schematic plan view of the shield member of Embodiment 2.
Figure 15:
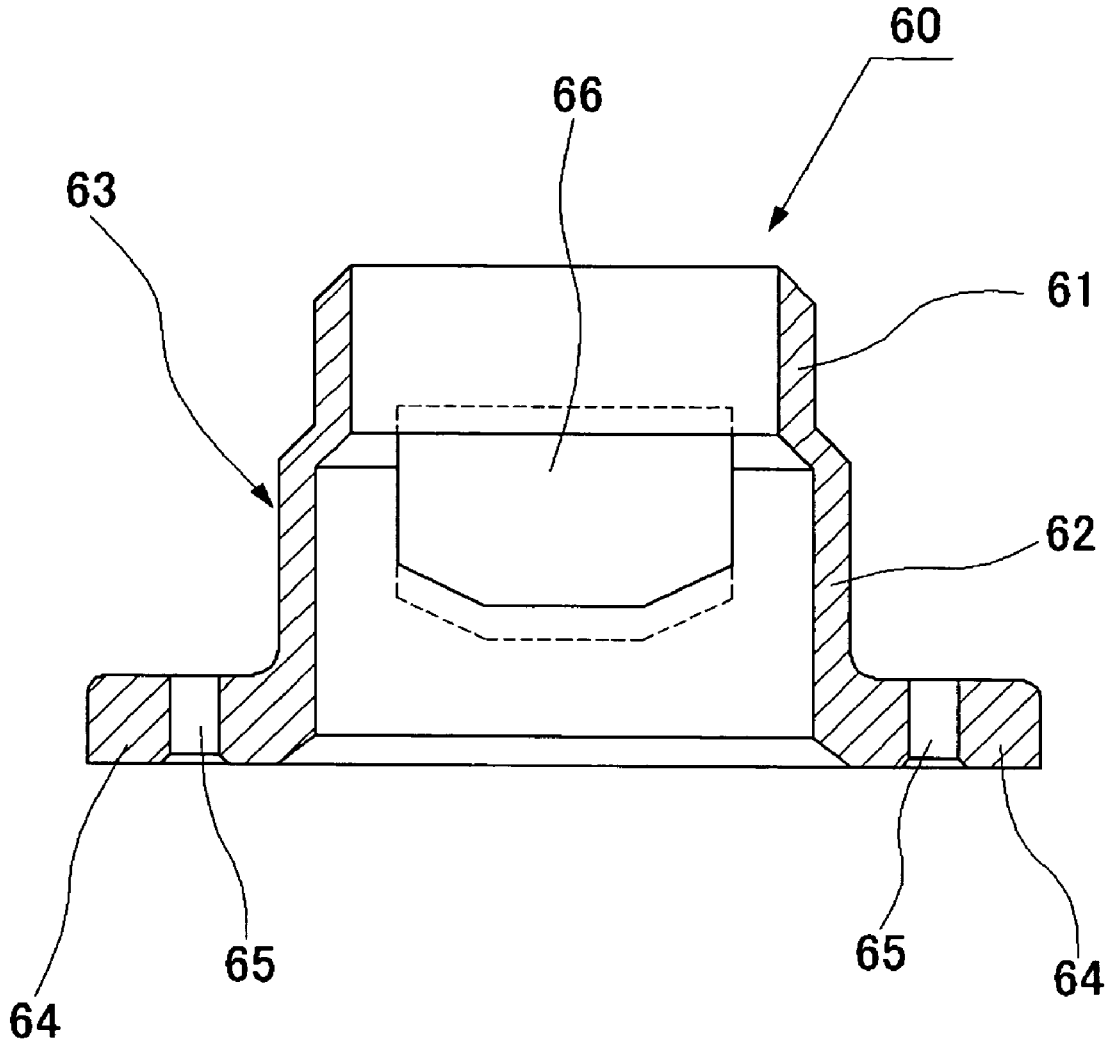
FIG. 15 is a sectional view taken on line E-E in FIG. 14.
Figure 16:
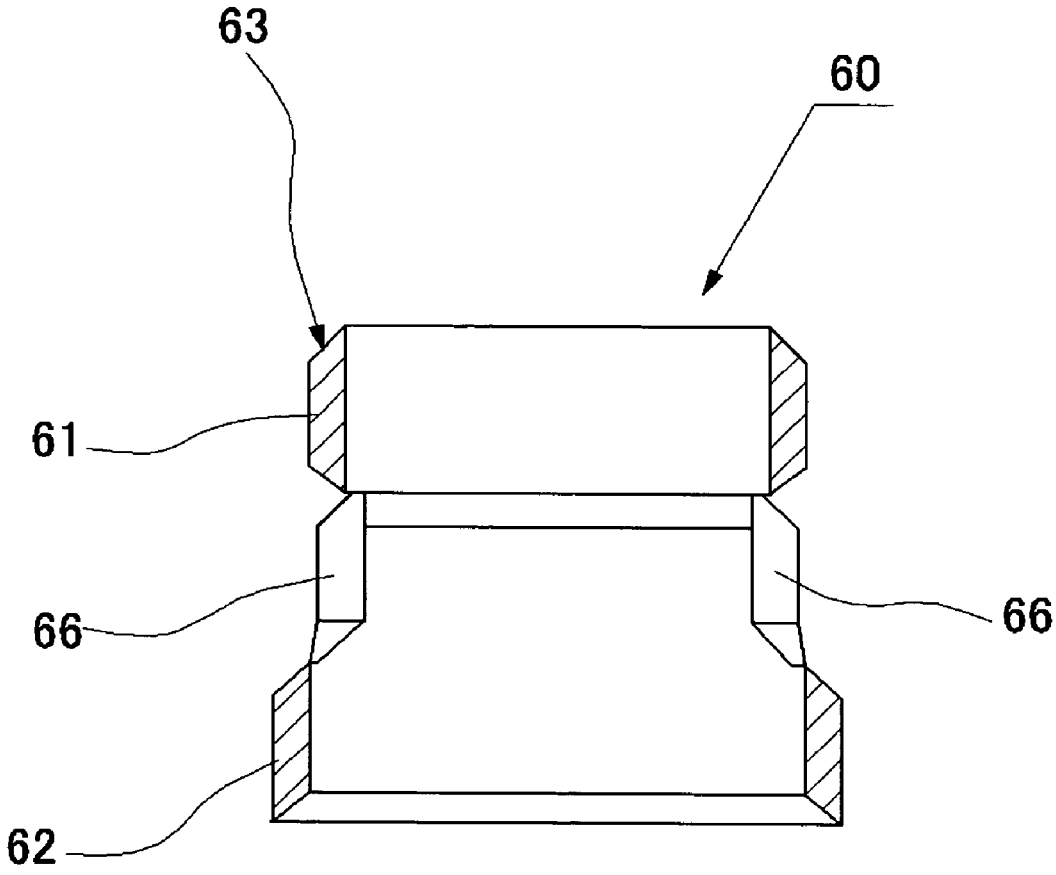
FIG. 16 is a sectional view taken on line F-F of FIG. 14.

As shown in FIGS. 14 to 16, the shield member 60 is provided with a shield body 63 in the form of a stepped tube having an upper small diameter section 61 and a lower large diameter section 62. At the lower end of the shield body 63, a pair of flanges 64 are projected radially outward from at radially opposite positions which are spaced from each other by 180 degrees. As clear from FIGS. 14 and 15, a positioning hole 65 is bored in each one of these flanges 64 to receive a head portion of a support pin 47 which is provided on the part of the hanger 40.

The inside diameter of the small diameter section 61 of the shield member 60 is slightly larger than the outside diameter of the piston crown 2 of the piston 1, more specifically, there is a diametrical differential of less than 2.5 mm between the small diameter portion 61 of the shield member 60 and the piston crown 2. Further, the inside diameter of the large diameter section 62 is sufficiently larger than the outside diameter of the skirt portion 3, more specifically, there is a diametrical differential larger than 20 mm between the large diameter portion 62 and the skirt portion 3. Openings 66 each with a predetermined angle range in the radial direction are provided in the shield member 60 at 90 degrees positions on the opposite sides of the flanges 64. Axially, each opening 66 ranges from a lower end portion of the small diameter section 61 to an intermediate portion of the large diameter section 62. Preferably, the openings 66 are formed to have an angular range of approximately 45 degrees around the outer periphery of the large diameter section 62 of the shield member 60.

In this connection, the support pins 47 serve as positioning means for the shield member 60 and at the same time as support means for supporting the shield member 60 in cooperation with the pedestal pins 48. As clear from FIG. 13, each support pin 17 is provided with a round-headed rod portion 47*a* which is projected upward from a pedestal portion 47*b*, and a screw portion 47*c* which is projected downward from the pedestal portion 47*b*. The screw portion 47*c* is threaded into a female screw shaft 47*d* which is fixedly provided on the support strip 43*a*. Interposed between the screw portion 47*c* and the female screw shaft 47*d* is a height adjustor ring 50. Thus, the height of the pedestal portion 47*b* can be adjusted by adjusting the degree of tightening of the screw portion 47*c* relative to the female screw shaft 47*c*. Further, each one of the pedestal pins 48 is provided with a flat-topped pedestal portion 48*a*, which is threaded into a female screw shaft 48*b*. A height adjustor ring 51 is interposed between the pedestal portion 48*a* and the female screw shaft 48*b*, so that the height or the position of the top end face of the pedestal portion 48*a* can be raised or lowered by adjusting the degree of tightening of the pedestal portion 48*a* relative to the female screw shaft 48*b*.

Therefore, upon adjusting the heights or the top end positions of the support pins 47 and the pedestal pins 48 to the same level, these pins are abutted against the lower end face of the large diameter portion 62 of the shield member 60. Besides, the two support pins 47 are received in the positioning holes 65 in the flange portions 64 of the shield member 50. Therefore, the shield member 60 can be supported on the hanger 40 in a stabilized state, and possibilities of positional deviations of the shield member 60 can be precluded by employing a minimum value for the diametrical differential between the support pin 47 and the positioning hole 65. Furthermore, the gripper leaf springs 49 are provided in opposing positions on the hanger 40. Therefore, as the shield member 60 is set in position on the hanger 40, the inwardly projecting clamp portions 49*a* of the gripper leaf springs 49 are pushed apart from each other by the shield member 60 and then brought into abutting engagement with the outer periphery of the large diameter section 62 of the shield member 60. Thus, the shield member 60 is fixedly gripped in position on the hanger 40 by the action of the gripper leaf springs 49.

Figure 17:
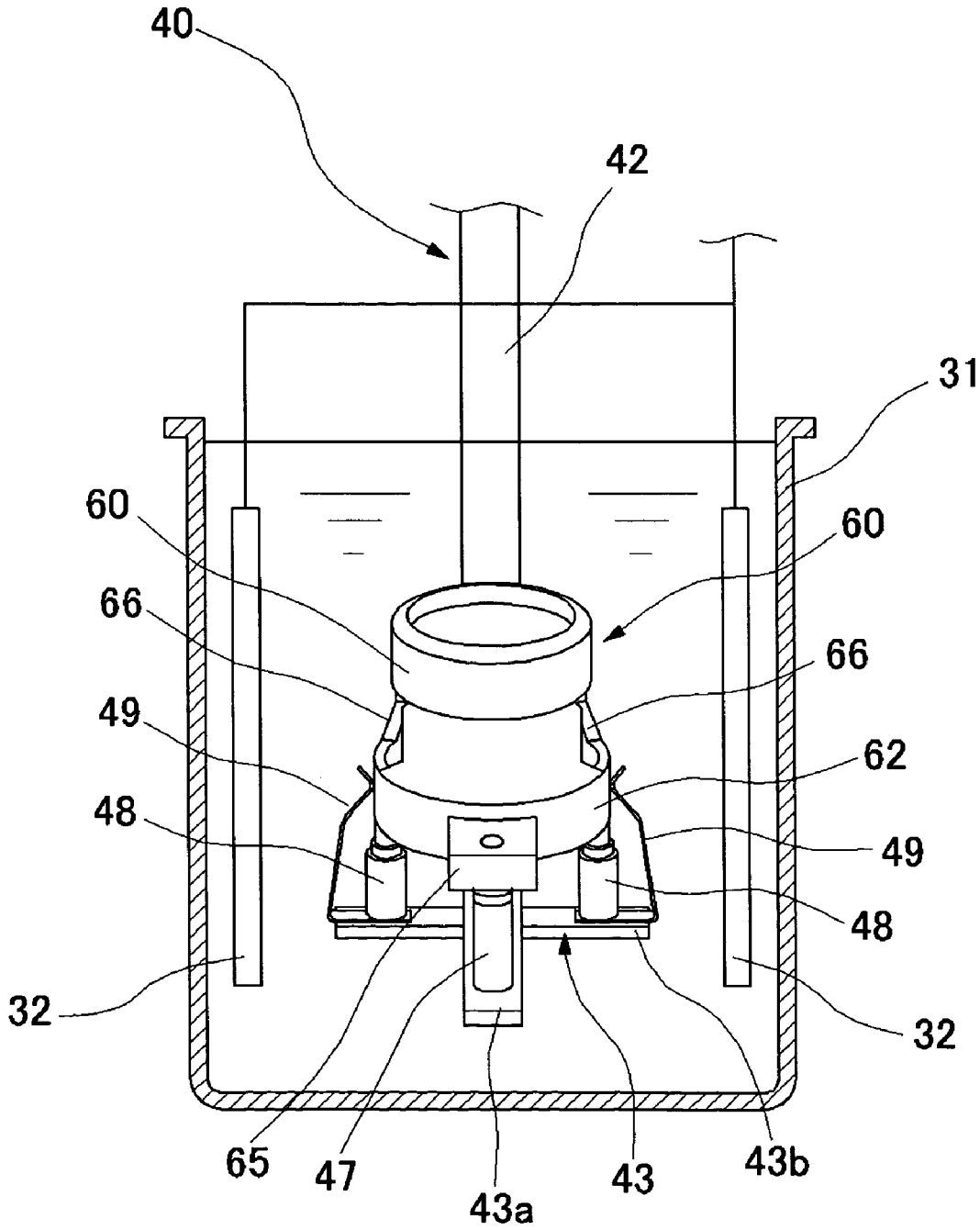
FIG. 17 is a schematic view of the piston undergoing a partial plating treatment in Embodiment 2.

As shown in FIG. 13, the mounter member 43 of the hanger 40 is tilted through a certain angle, preferably, through an angle of from 15 to 30 degrees relative to the vertical hanger bar 42. Accordingly, the piston 1 which is supported on the hanger 40 as well as the shield member 60 which is set on the hanger 40 in such a way as to cover in the piston 1 is held in a tilted state. Therefore, when the vertical hanger bar 42 of the hanger 40 is lowered vertically into the plating bath 31 as shown in FIG. 17, the piston 1 and the shield member 60 are tilted forward along the opposing surfaces of the anode plates 32. At this time, each opening 66 in the shield member 60 is faced toward an anode plate 32. The hanger 40 itself is made of a conductive metal and encased in an insulating cover. However, the insulating cover is stripped off at the hook portion 42*a* which serves as a contact point for power supply to the piston 1, at the most projected shoulder portions 46*a* of the piston holder leaf springs 46 which are held in contact with the piston 1, and at top end faces 45*a* of the upwardly bent end portions of the piston receptacle strip 45 which also function as current conducting contact points. Thus, while contact points on the piston holder leaf springs 46 and the piston receptacle strip member 46 are abutted against the piston 1, the hook portion 42 which is electrically connected with the vertical hanger bar portion 42 of the hanger 40 is engaged with a hanger transfer rod which is connected with a direct-current power supply as in the foregoing first embodiment.

Even in the case of the second embodiment which is arranged as described above, it is possible to partially plate the piston 1 except the piston crown portion 2, depositing a metallic coating of uniform thickness specifically on the sliding surfaces 3*a* on the skirt portion 3 of the piston 1 in the same manner as in the first embodiment.

The hanger 40 as well as the piston 1 and the shield member 60 which are mounted on the hanger 40 are set in a tilted posture in such a way as to exclude flat horizontal surfaces. Therefore, when the hanger 40 is lifted up after immersion in a plating bath or other treating bath, the plating or treating solution is urged to flow down along tilted surfaces and smoothly get back to the plating or treating bath. Accordingly, before coming to an end of an uplifting stroke, the plating or treating solution is substantially completely drained off the piston 1, the shield member 60 and the hanger 40, including dipped surface portions on the top end of the piston 1. As a result, it becomes possible to reduce the consumption of the plating and treating solutions which are carried out from the respective baths with the hanger 40, that is to say, it becomes possible to prevent contamination of a succeeding bath by a solution of a preceding bath.

Further, the piston 1 and the shield member 60 which is placed partially around the piston 1 in small gap relation with the latter can be separately and independently set on and off the hanger 40. The support post 44 is provided on the hanger 40 for mounting a piston 1 thereon. As a piston 1 is put on the support post 44, the piston holder leaf springs 46 are received in the inner cavity of the piston 1, and the most projected portions 46*a* of the leaf springs 46 are resiliently deformed by lower marginal end portions of the skirt portion 3 of the piston 1. That is to say, the two piston holder leaf springs 46 which are provided in radially opposing positions are flexed toward each other as the piston 1 is put on the support post 44. The piston 1 is retained in position on the support post 44 by gripping actions of the piston holder leaf springs 46 as soon as an inner surface of the piston crown portion 2 is set on the piston receptacle strip member 45 at the top end of the support post 44.

In the next place, the shield member 60 is set on the hanger 40 in such a way as to circumvent the piston 1 in small gap relation therewith as described above. As the piston 1 is mostly covered in the shield member 60, the lower end of the shield member 60 gets into the space between the inwardly bent clamp portions 49*a* of the paired gripper leaf springs 49 via the outwardly bent upper end portions 49*b*, spreading apart the inwardly bent clamp portions 49*a*. Thereafter, the support pins 47 are placed in the positioning holes 55 in the flange portions 54 of the shield member 60. As a result, the shield member 60 is oriented to its position on the hanger 40, and, as the support pins 47 are fully inserted in the positioning holes 55, the lower end of the shield member 60 is set on the top end surfaces of the pedestal portions 47*b* of the support pins 47 and the pedestal portions 48*a* of the pedestal pins 48 and at the same time gripped by the inwardly bent clamp portions 49*a* of the gripper leaf springs 49. Thus, the shield member 60 is fixedly retained in position on the mounter member 43 of the hanger 40.

After setting the piston 1 and the shield member 60 fixedly on the hanger 40 in the manner as described above, they are successively immersed in various treating baths to complete a partial plating process. In the course of the plating process, there is little possibility of the piston 1 and the shield member 60 spontaneously coming out of respective positions.

Upon completing a plating process, firstly the shield member 60 is dismantled from the hanger 40. After removing the shield member 60, the partially plated piston 1 can be easily picked up from the hanger 40, with no possibilities of collision against any other member of the hanger 40.

What is claimed is:

1. A method for partially plating a work for a piston, said work having sliding portions on a skirt portion under a lidded piston crown portion with annular circumferential grooves therearound, and having a boss portion to receive a piston pin, said method comprising the steps of:

providing a plating bath filled with an electrolyte and having two anode plates set in position within said plating bath;

directly supporting said work on a hanger adapted to immerse said work in said plating bath, said piston crown portion positioned above said skirt portion;

providing an electrically insulated shield member directly supported on said hanger, wherein said work is supported on said hanger in such a way as to close said annular circumferential grooves of said piston crown portion while retaining small gap relation with said piston crown portion, wherein the piston crown and the shield member do not contact one another, and said shield member being provided with openings to expose the sliding surfaces of said skirt portion;

immersing said work in said plating bath; and depositing a plating metal on said sliding surface on said skirt portion, said hanger supporting said work and said shield member at a position between said two anode plates in said plating bath and in a tilted posture parallel with said anode plates while conducting current between said work serving as a cathode and said anode plates, wherein said work and said shield member are supported by the hanger in a tilted posture before being immersed in the plating bath, during the depositing of the plating metal and after being removed from the plating bath.

2. A method for partially plating a work for a piston as defined in claim 1, wherein said sliding surfaces are provided on the skirt portion on opposite sides of said boss portion, and disposed face to face with said anode plates through said openings in said shield member when in said plating bath.

3. A method for partially plating a work for a piston as defined in claim 1, wherein said shield member is constituted by a generally tubular structure fixedly mounted on said hanger adapted to hold said work internally of said tubular structure.

4. A method for partially plating a work for a piston as defined in claim 1, wherein said shield member is detachably provided on said hanger, said hanger being provided with a first support portion for supporting said work and a second support portion for supporting said shield member, along with a hook member to be disengageably engaged with a cathode member.

5. A method for partially plating a work for a piston as defined in claim 1, wherein said shield member is provided on said hanger at a gap space narrower than 5 mm, inclusive, from a work surface.

* * * * *